US005472190A

United States Patent [19]

Norling

[11] Patent Number: 5,472,190

[45] Date of Patent: Dec. 5, 1995

[54] RACKET HANDLE GRIP

[76] Inventor: Phillip Norling, 18862 Mesa Dr., Villa Park, Calif. 92667

[21] Appl. No.: 358,360

[22] Filed: Dec. 19, 1994

[51] Int. Cl.[6] ..... H63B 49/03

[52] U.S. Cl. ..... 273/73 J; 273/75; 273/51 D

[58] Field of Search ..... 273/73 J, 75, 81 R, 273/165, 81.2, 81 B, 81 C, 81 D

[56] References Cited

U.S. PATENT DOCUMENTS

| | | | |
|---|---|---|---|
| 739,450 | 9/1903 | Schnek | 273/73 J |
| 1,730,820 | 10/1929 | Holden | 273/73 J |
| 5,080,363 | 1/1992 | Soong | 273/73 J X |
| 5,094,453 | 3/1992 | Douglas et al. | 273/73 J |
| 5,257,782 | 11/1993 | Schicketany | 273/73 J |
| 5,322,280 | 6/1994 | Wu | 273/73 J |
| 5,366,218 | 11/1994 | Gong | 273/73 J |

FOREIGN PATENT DOCUMENTS

| | | | |
|---|---|---|---|
| 2230458 | 10/1990 | United Kingdom | 273/73 J |

*Primary Examiner*—William E. Stoll
*Attorney, Agent, or Firm*—Plante & Strauss

[57] ABSTRACT

There is discloses a grip for a racket handle, particularly for tennis rackets, which comprises a cage that is secured to the racket handle and into which the player inserts his hand to grip the racket handle. The cage has a generally circular loop adjacent the base of the racket handle which surrounds the player's wrist and has a base plate dependent therefrom which rotatably supports the end of the racket handle. The cage includes at least a pair of longitudinal stringers which extend from the base plate to a ring that surrounds the racket handle adjacent its upper end. A strengthening stringer extends from the top of the wrist loop longitudinally along the handle, terminating in attachment to the ring at the opposite end of the cage. One or more reinforcing ribs can be located intermediate the length of the ribs to stiffen the structure.

17 Claims, 1 Drawing Sheet

RACKET HANDLE GRIP

BACKGROUND OF THE INVENTION

1. Field of Invention

This invention relates to a device for racket handles and, in particular to a device for training and strengthening a player's performance with a tennis racket.

2. Brief Statement of the Prior Art

Novices and students learning tennis often develop habits of gripping a tennis racket which are difficult to overcome, and which can lead to sprains and injuries. Various devices have been proposed as useful to increase a player's grip of a tennis racket, including those described in the following patents:

U.S. Pat. No. 5,018,734 discloses a handle grip with lever to locate one's hand about the handle.

U.S. Pat. No. 3,868,110 discloses a detachable grip for tennis racquet handles which is molded with finger and hand indentations accommodating positions of the hand for different strokes.

U.S. Pat. No. 4,226,418 discloses a hand grip for a racket handle with a textured surface for the thumb and hand and a web with holes for engagement by the fingers of the hand.

U.S. Pat. Nos. 4,664,381, 4,836,544 and 4,943,058 disclose anatomical grips for tennis rackets which can be selectively positioned relative to the racquet.

U.S. Pat. No. 5,257,782 discloses a racquet grip having a pair of arms which retain and bear against the rear surfaces of the hand adjacent to the thumb and heel portions of the hand.

U.S. Pat. No. 3,712,618 discloses a wrist and hand brace which is attached to a tennis racket handle.

OBJECTIVES OF THE INVENTION

It is an objective of this invention to provide an improved grip for a racket handle.

It is also an objective of this invention to provide an improved grip for a tennis racket handle.

It is also an objective of this invention to provide a grip which aids in training of tennis players, and strengthening of their game.

It is likewise an objective of this invention to provide a handle grip that will reduce the opportunities for injuries during tennis training.

Other and related objectives will be apparent from the following description of the invention.

BRIEF DESCRIPTION OF THE INVENTION

This invention comprises a grip for a racket handle, particularly for tennis rackets which aids in training players, and in strengthening a player's game. The device comprises a cage which is secured to the racket handle and into which the player inserts his hand to grip the racket handle. The cage has a generally circular loop adjacent the base of the racket handle which surrounds the player's wrist and has a base plate dependent therefrom which rotatably supports the end of the racket handle. The cage includes at least a pair of longitudinal stringers which extend from the base plate to a ring that surrounds the racket handle adjacent its upper end. A strengthening stringer extends from the top of the wrist loop longitudinally along the handle, terminating in attachment to the ring at the opposite end of the cage. One or more reinforcing ribs can be located intermediate the length of the ribs to stiffen the structure.

BRIEF DESCRIPTION OF THE DRAWINGS

The invention will be described with reference to the FIGURES of which.

DESCRIPTION OF PREFERRED EMBODIMENT

Figure 1:
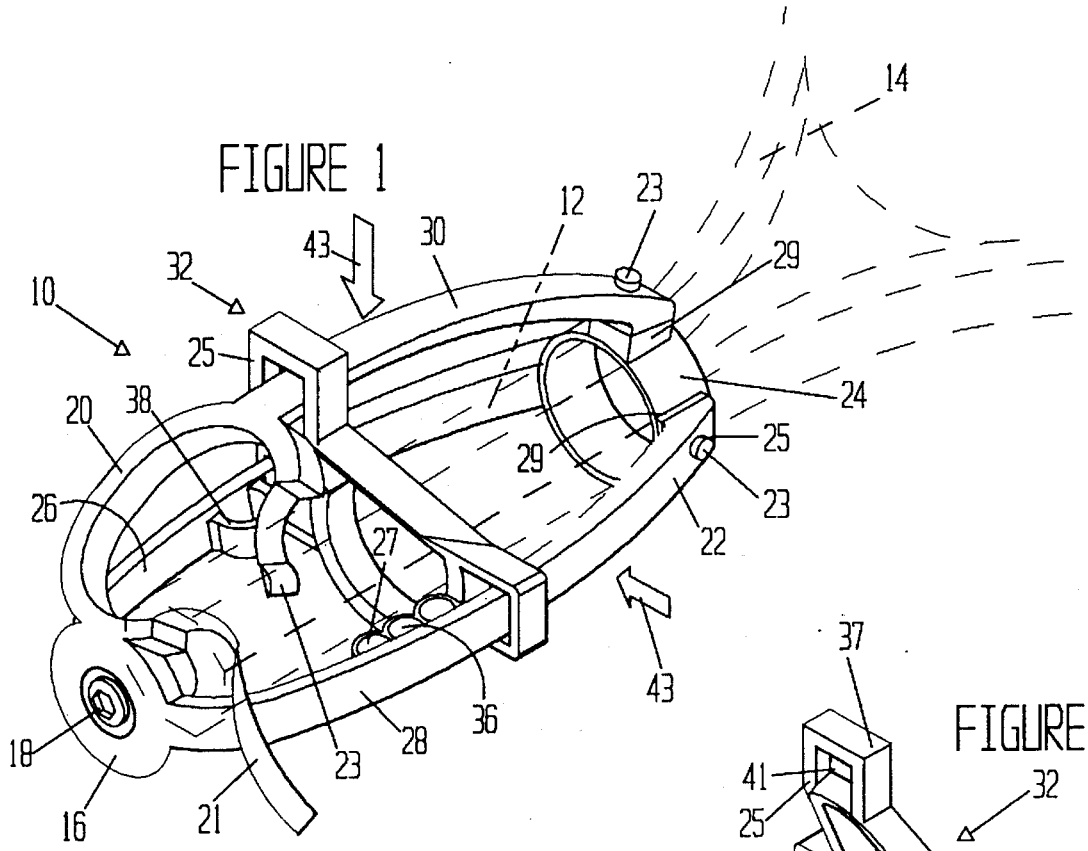
FIG. 1 is a perspective view of the grip of the invention applied to the handle of a tennis racket.

Referring now to FIG. 1, the hand grip of the invention is generally described as a cage 10 that receives the handle 12 of a tennis racket 14, the latter being shown in phantom lines. The cage 10 is formed with a base plate 16 that has a through aperture in which is placed a shaft member, e.g., screw 18, which is secured into the end of the tennis racket handle 12 and which provides rotatable support of the handle 12 within the cage 10. The base plate 16 also supports a large diameter loop member 20 which is of sufficient size to permit one to pass one's hand through the loop member 20 and into the cage 10.

Figure 3:
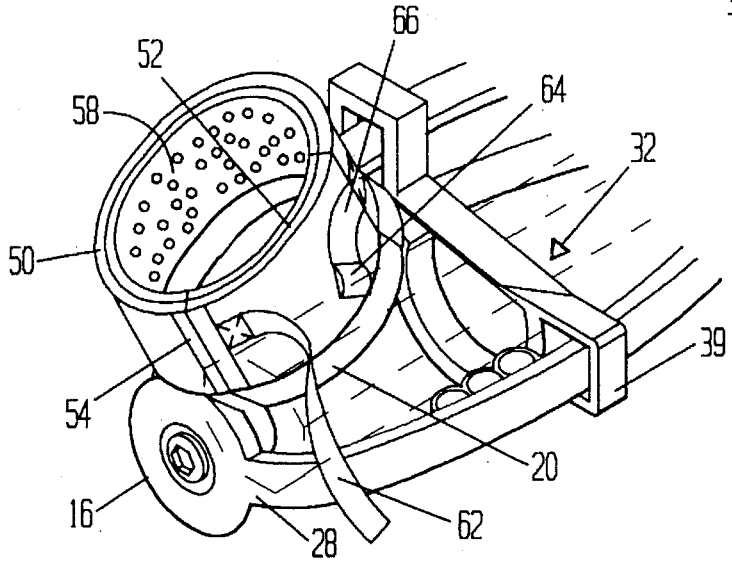
FIG. 3 is a perspective view of an embodiment of the invention which includes a wrist cuff.

The base plate 16 is an integral, one-piece member with the loop 20 which, as shown in FIG. 3, projects forwardly and upwardly therefrom at an approximate angle of from 20 to about 40, preferably 30° to the axis of the handle 12, corresponding to an orthogonal position relative to the player's wrist during normal use. This loop 20 is illustrated in FIG. 1 as a discontinuous loop, open along one side, with a fabric or leather band 21 which has a buckle 23 to permit tightening the band about the player's wrist.

At its opposite end 22, the cage 10 has a ring 24 which coaxially surrounds the handle 12 of the tennis racket 14 to permit its rotational support within the cage 10. The ring 24 is secured in the assembly by at least a pair of stringers 26 and 28 which extend from the base plate 16, longitudinally along the racket handle 12 and into attachment to the upper ring 24. Additionally, a third stringer 30 projects from the loop member 20 into attachment to the ring 24, thereby providing a three-point support of the ring 24 in the assembly.

The longitudinal stringer 30 is integral and one-piece with the loop, and the lateral stringers 26 and 28 are preferably integral, one-piece with the base plate, thereby simplifying the construction and assembly of the grip.

The stringers 26, 28 and 30 provide a fairly rigid and strong cage 10 surrounding the racket handle, which transmits the player's wrist movements to the upper end of the racket handle 12, thereby providing a significant lever advantage.

The stringers are secured to the ring 24 with an elastic attachment which includes posts 23 that are permanently secured to the ring and that extend through receiving through apertures in the ends of the stringers. The outer ends of the posts have heads 25 to capture the stringers in the assembly. Each stringer also has a compressible pad or cushion 29 which bears against the ring, thereby providing a elastic or resilient attachment between the stringers and ring 24.

Figure 2:
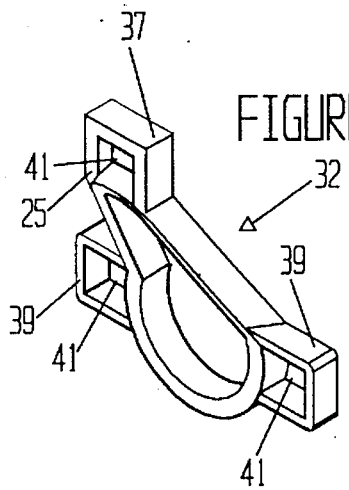
FIG. 2 is a perspective view of the center rib of the grip of the invention.

Preferably, to provide rigidity and strength to the unit 10, a rib 32 is located intermediate the length of the cage 10. The rib is shown in FIG. 2, and has a generally ellipse configuration with the upper portion 33 of the ellipse is preferably tilted at an angle from about 60° to about 80° relative to the longitudinal axis of the handle 12 towards the base of the racket handle, which places its upper edge 35 adjacent the loop 20.

The rib 32 has an upper bracket 37 and two lateral brackets 39 which have central slots 41 which receive the longitudinal stringers. The slots 41 slidably receive the stringers as the radial lengths of the slots are greater than the thicknesses of the stringers thereby permitting the elastic compression of the stringers, in the directions indicated by the arrowhead lines 43.

The lateral stringers 26 and 28 have finger grips, such as the three-finger-bracket 36 on the inside surface of stringer 28 and the thumb bracket 38 on the inside surface of stringer 26. Preferably the through apertures 27 of these brackets are tilted, similarly to the tilt of the upper portion of the rib, to align with the players fingers and thumb.

In use, the player's hand is inserted through the loop member 20 and the player's fingers and thumb are inserted through the apertures 27. The player then grips the racket handle 12, which compresses the stringers 26 and 28 and the pads 29 against the ring 24.

Referring now to FIG. 3, there is illustrated an alternative construction for the loop member to include a wrist band. As there illustrated, the loop member 20 is extended by a band 50 which is discontinuous, as loop 20, and has a closure 52 which is secured by a hinge 54 to the band 50. The interior surface 56 of the band 50 and closure 52 can be lined with a cushion or compressible foam layer 58 for comfort. The closure 52 can be secured in a closed configuration with a flexible band 62 which has one end secured to the closure 52 and the other end secured with an adjustable buckle 64 which is supported by a second flexible band 66. If desired, the upper edge of the loop and closure member 52 can have a roll cushion (not shown) for additional comfort.

The invention is intended primarily as a training aid for tennis. The device limits the flexibility of the player's wrist and ensures a more rigid connection of the tennis racket handle and the player's arm. Additionally, the device strengthens the player's game because the cage provides an enhanced lever moment, reducing the requirement for the player to clench his fingers tightly about the racket handle. Since the device limits the extent of wrist action or snap and because the device strengthens the player, it will significantly reduce the tendency for injuries such as sprained wrists or elbows or torn ligaments. The player's grip of the tennis racket and freedom in adjusting that grip, e.g., rotating of the racket handle between backhand and forehand swings, etc., is not compromised as the unit permits unfettered rotation of the racket handle. Since the unit limits the freedom or flexibility of the player's wrist, the player more quickly masters the tennis game and is able to control the precision and placement of shots.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A grip enhancing device including a game racket handle having a racket end from which is supported a racket, and an opposite, free end, which device comprises:

a. a foraminous body having an end plate which is rotatably attached to the free end of said game racket handle and is attached at its opposite end by a ring which surrounds said handle;

b. a wrist band supported on said end plate at an oblique angle thereto;

c. at least a first brace integral with said end plate or said wrist band and extending longitudinally along said handle; and d. attachment means securing the end of said first brace to said ring adjacent the racket end of said racket handle.

2. The device of claim 1 also including at least a second brace which extends longitudinally along said handle and also secured by said attachment means to said ring adjacent the racket end of said racket handle, and wherein said first and second braces are integral with said end plate and extend along opposites sides of said device.

3. The device of claim 2 including a third brace extending longitudinally along said handle from said wrist band to said ring and secured thereto by attachment means.

4. The device of claim 3 including finger and thumb grips on the inside surfaces of said first and second braces.

5. The device of claim 3 including a rib located intermediate said end plate and said ring, and having at least two lateral, radially projecting brackets having through slots which slidably receive said first and second braces.

6. The device of claim 5 wherein said rib is elliptical in cross section, and has its upper end projecting towards said wrist band, and supports an upper bracket having a slot that slidably receives said third brace.

7. The device of claim 1 wherein said attachment means includes a compressible pad between the end of said brace and said ring.

8. The device of claim 7 wherein said ring is located in a plane orthogonal to the axis of said handle.

9. The device of claim 1 including finger grips along the inside surface of said brace.

10. A grip enhancing device including a game racket handle having a racket end from which is supported a racket, and an opposite, free end, that is normally gripped by a user with the user's hand and fingers encircling the handle and the user's wrist oriented obliquely to the axis of said handle, which device comprises:

a. a foraminous body having an end plate which is rotatably attached to the free end of said game racket handle and which is attached at its opposite end by a ring which surrounds said handle;

b. a wrist band supported on said end plate at an oblique angle thereto so as to be substantially orthogonal to the user's wrist;

c. at least a first brace extending from said plate or said wrist band longitudinally along said handle; and d. attachment means securing the end of said brace to said ring adjacent the racket end of said racket handle.

11. The device of claim 10 including second and third braces extending longitudinally along said handle from said end plate and said wrist band to said ring, with said first and second braces located at opposites sides of said device and integral with said base plate and said third brace integral with said wrist band and extending along the top of said device.

12. The device of claim 11 including finger and thumb grips on the inside surfaces of said first and second braces.

13. The device of claim 11 including a rib located intermediate said end plate and said ring, and having at least two lateral, radially projecting brackets having through slots which slidably receive said first and second braces.

14. The device of claim 13 wherein said rib is elliptical in cross section, and has its upper end projecting towards said wrist band, and supports an upper bracket having a slot that slidably receives said third brace.

15. The device of claim 10 wherein said attachment means includes a compressible pad between the end of said brace and said ring.

16. The device of claim 15 wherein said ring is located in a plane orthogonal to the axis of said handle.

17. The device of claim 10 including finger grips along the inside surface of said brace.

* * * * *